United States Patent [19]

Hendricks

[11] 4,441,387

[45] Apr. 10, 1984

[54] OPEN END RATCHET WRENCH

[76] Inventor: Bacel G. Hendricks, 1190 E. Beecher, Brigham City, Utah 84302

[21] Appl. No.: 387,543

[22] Filed: Jun. 11, 1982

[51] Int. Cl.[3] ..... B25B 13/46; B25B 13/00

[52] U.S. Cl. ..... 81/61; 81/58.2

[58] Field of Search ..... 81/58.2, 60–63.2; 192/46; 74/577 S

[56] References Cited

U.S. PATENT DOCUMENTS

| | | | |
|---|---|---|---|
| 663,421 | 12/1900 | Daniels | 81/61 |
| 697,321 | 4/1902 | Brown | 81/61 |
| 1,088,716 | 3/1914 | Monaghan | 81/58.2 |
| 2,757,564 | 8/1956 | Reaves | 81/61 X |

*Primary Examiner*—Frederick R. Schmidt
*Assistant Examiner*—Debra S. Meislin
*Attorney, Agent, or Firm*—A. Ray Osburn

[57] ABSTRACT

An open ended ratchet wrench comprising a wrenching disc having a radially disposed open ended nut recess, carrying pivoting tongue ratchet pawls, the disc held between two jaws with ratchet teeth engaged by the pawls. One of the jaws is pivotally retractable for installation and removal of the interchangeable wrenching disc. The handle carrying the jaws may be installed upon or removed from the disc regardless of the position of the nut recess and either laterally or longitudinally in respect to the nut. According to one aspect of the invention, a retractable jaw is pivotally connected to the handle and retained by matching notches in the jaw and the handle. The jaw pivot pin carries an eccentric cam which acts against an appropriately shaped perforation in the retractable jaw to disengage the notches.

8 Claims, 11 Drawing Figures

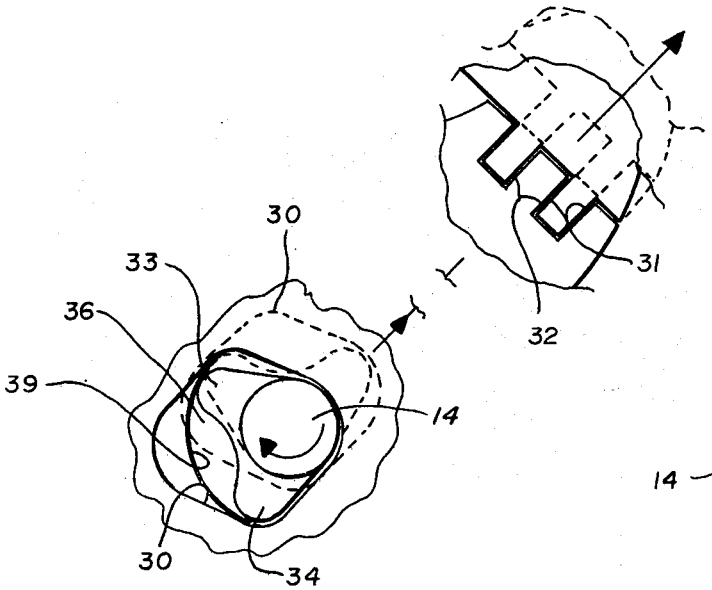
fig. 8
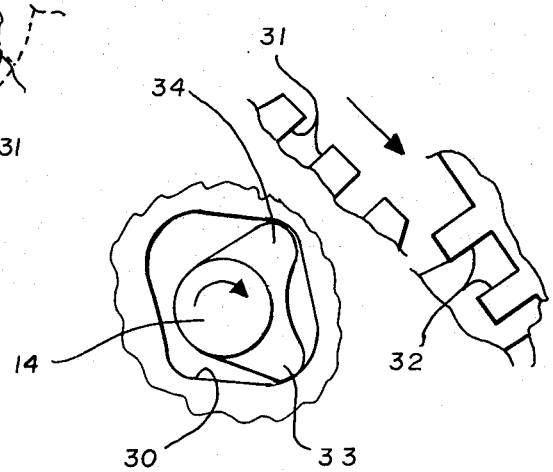
fig. 9
fig. 10
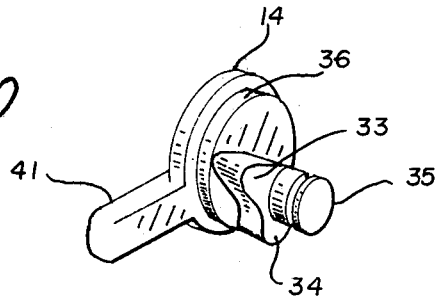
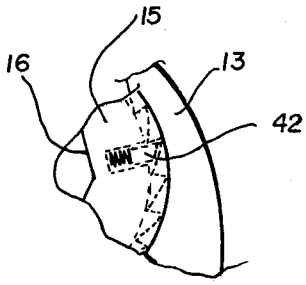
fig. 11

OPEN END RATCHET WRENCH

BACKGROUND OF THE INVENTION

1. Field:

The field of the invention is ratchet-type wrenches and more particularly those of the open end or broken circle design.

2. Prior Art:

None of the previous embodiments of open ended ratchet wrenches have fully exploited the potential of such wrenches. These prior designs are commonly so bulky as to seriously impair their usefulness in restricted work areas. Some are less bulky, but suffer from impaired strength, limiting their usefulness for heavy wrenching and shortening their useful life. The handle operated, spring loaded jaw of U.S. Pat. No. 2,757,564, substantially increases the working space required, and the entire wrenching force must be resisted by a small jaw pivot pin. Similarly, the jaw mounted ratchet pawls in U.S. Pat. No. 2,401,128 substantially increase the size of the jaws of the wrench. U.S. Pat. No. 2,376,575, discloses similar jaw mounted pawls undesirably increasing the necessary width of the wrench. The insertion and retention of the wrenching discs in the prior designs involve complicated components, such as the spring clip of U.S. Pat. No. 2,401,128 and the sliding arcuate key of U.S. Pat. No. 2,376,575. Both of these designs require removal of the wrenching insert laterally of the wrench, increasing required lateral space for use of the wrench. U.S. Pat. No. 1,081,117 has two rotating jaws, used only to laterally retain the wrenching disc, thus providing no strength but nevertheless increasing the size of the wrench. Ratchet teeth on the disc circumference are engaged by a pivoting pawl in the strength bearing portion of the wrench. Because of the rotating retaining jaws, the strength bearing portion of the wrench head is necessarily thinner or the wrench unnecessarily thick. The permissible wrenching force is limited since it must be resisted by the small pawl pivot pins.

BRIEF SUMMARY OF THE INVENTION

With the foregoing in mind, the disadvantages of the prior art are eliminated or substantially alleviated by providing a ratchet end wrench having a wrenching head with a nut engaging wrenching disc carrying at least two ratchet pawls which may be recessed within the wider portions of the disc. A pair of disc engaging jaws is provided at the end of the wrench handle. Each jaw has ratchet teeth on an arcuate inwardly facing surface. The wrench may be operated by oscillatory motion of the handle, the teeth being alternately engaged and released by the pawls.

One of the jaws is fixed to the handle. The other is retractably mounted through a large pivot pin to the handle near its head end, and is releasably held in disc engaging position during wrenching. Preferably, the pivot pin carries an eccentric cam and is manually rotatable so that the cam engages the walls of an appropriately shaped perforation in the retractable jaw to force it into or out of engagement with the disc. The retractable jaw and the handle may be held in rotation resisting, force transferring engagement together by matching notches. Jaw engaging lips may be provided on the wrenching disc to prevent lateral disengagement until the jaw is partially retracted. Because of these features, neither the discs, the jaws nor the handle need be enlarged to provide necessary strength to provide for pawl recesses or jaw pivot pin, so that the utility of the wrench for use in restricted spaces is unimpaired. Further, the nut may be engaged and disengaged, as required by the restricted working space, either longitudinally or laterally to the wrench. These and other advantages of the ratchet end wrench will be apparent from the following detailed description made with reference to the accompanying drawings.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
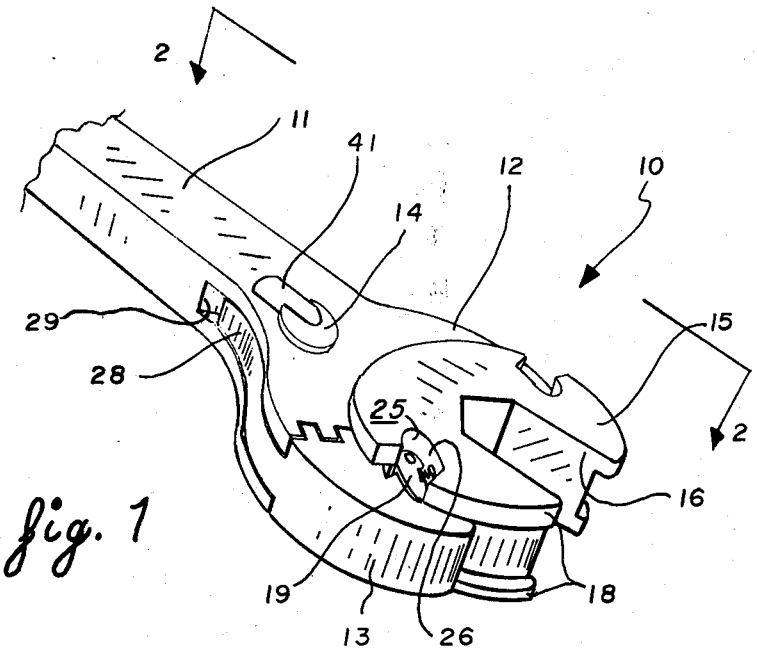
FIG. 1 is a perspective representation of the head end of the ratchet end wrench along with a portion of the handle thereof, drawn to substantially full scale, FIG. 2 a side elevation view of the wrench of FIG. 1 taken along line 2—2 thereof, drawn to the same scale, FIG. 3 a cross sectional view of the wrench of FIG. 2 taken along line 3—3 thereof, drawn to the same scale, FIG. 4 an edge elevation view of the wrench of FIG. 2 taken along line 4—4 thereof, drawn to the same scale, FIG. 5 an edge elevation view of the wrenching disc of the wrench of FIG. 2 separated therefrom, drawn to the same scale, FIG. 6 a cross sectional view of a fragment of the wrench of FIG. 4 taken along line 6—6 thereof, drawn to the same scale, FIG. 7 a side elevation view of the wrench of FIG. 2 with the movable jaw thereof in retracted position and the wrenching disc thereof removed therefrom, drawn to the same scale, FIG. 8 an enlarged cross sectional view of fragments of the cross sectional view of FIG. 6 showing the cam lugs and pin, the cam perforation and the jaw retaining notches in engaged and disengaged positions, FIG. 9 a view of the fragments of FIG. 8 wherein the retractable jaw is fully retracted, drawn to the same scale, FIG. 10 an enlarged perspective view of the cam pin of the wrench of FIG. 1, and FIG. 11 a view of a fragment of an embodiment of the wrenching disc of the wrench of FIG. 1, having sliding bolt pawls, drawn to the scale of FIG. 2.
Figure 2:
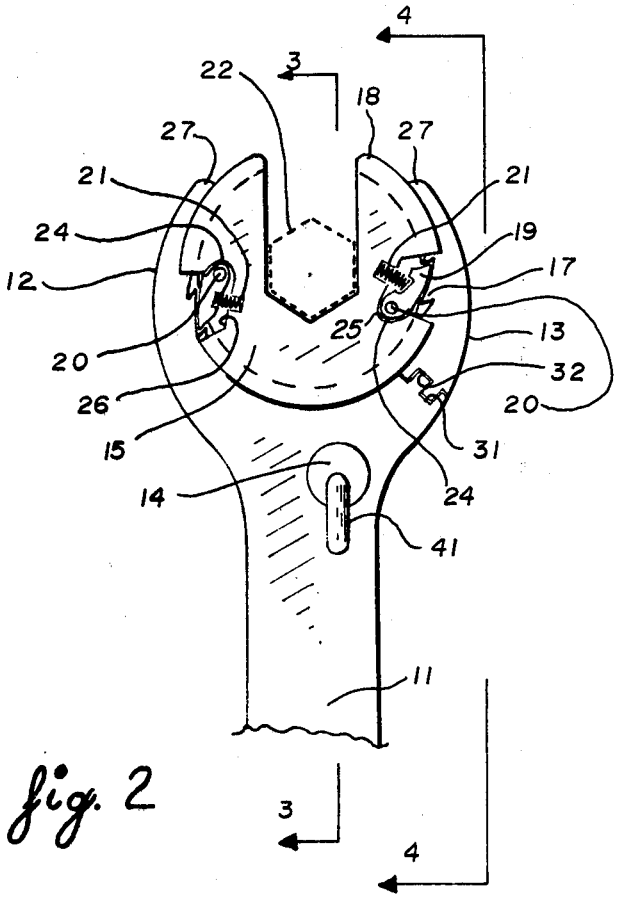
Figure 3:
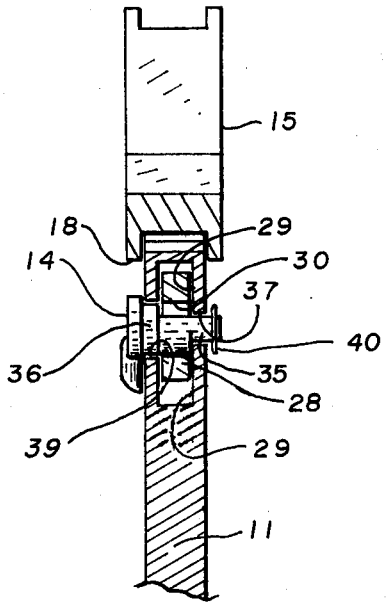
Figure 4:
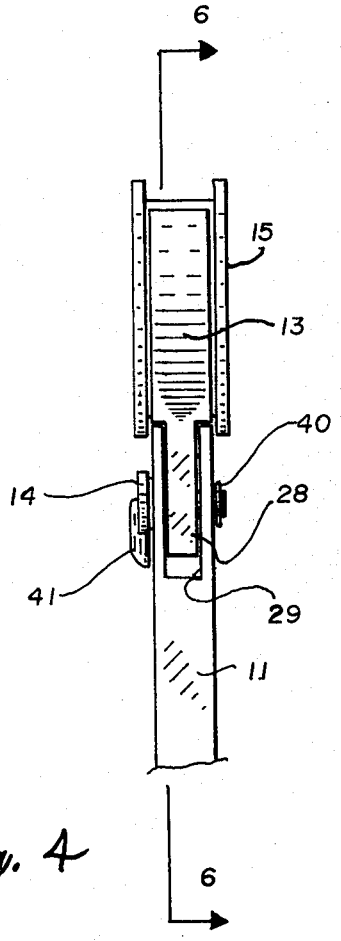
Figure 5:
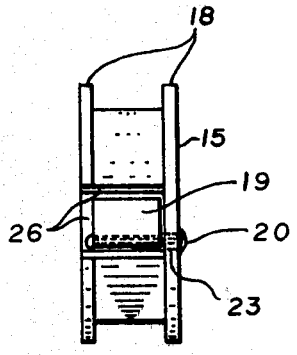
Figure 7:
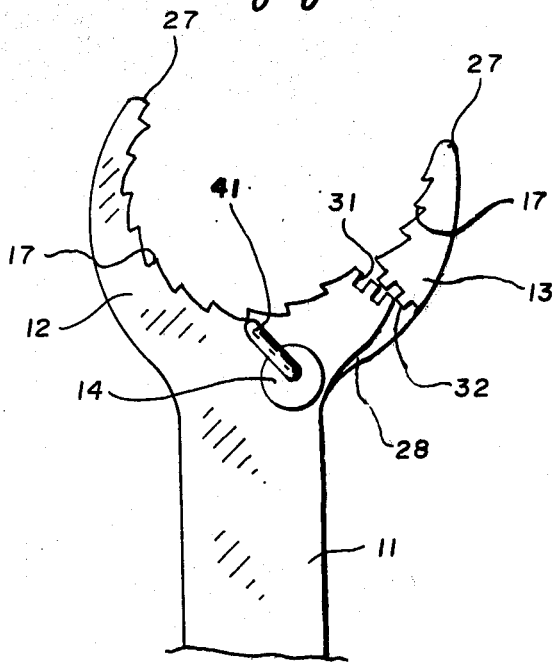

The embodiment of ratchet and wrench 10, illustrated in FIGS. 1–10 comprises a handle 11 with a fixed jaw 12 integral therewith, and a retractable jaw 13 pivotal about a cam pin 14 which secures jaw 13 generally rotatably to handle 11. (FIG. 6) A circular wrench disc 15, with an open-ended nut receiving recess 16, is adapted to be held rotatably between jaws 12 and 13. Jaws 12 and 13 have facing circularly arcuate inside surfaces provided with ratchet teeth 17. Wrenching disc 15 is removably retained between jaws 12 and 13, jaw 12 spanning substantially one-half its circumference, and the two together embracing substantially more. Outstanding lips 18 retain disc 15 against lateral dislodgement from between the jaws. Discs 15 with variously sized nut recesses 16 may be interchangeably used with a single handle and jaw assembly.

Jaw 13 is retracted to install or remove disc 15. (FIG. 7) For initial engagement of nut 22, disc 15 may be positioned with nut recess 16 facing outwardly between the ends 27 of jaws 12 and 13. (FIG. 2) Or, disc 15 may be separately placed about nut 22 and subsequently engaged by the jaws regardless of the position of the nut recess. When nut 22 has been tightened or loosened as desired, jaws 12 and 13 may be removed from disc 15 regardless of the position of nut recess 16. Disc 15 may be engaged or released, as may be required by the available working space, by motion of handle 11 parallel or laterally to its length. For the sideways removal or engagement, jaw 13 need only be rotated away from disc 15 sufficiently for the jaws to clear the appropriate one of lips 18.

At least two ratchet teeth engaging pivoted tongue pawls 19 are provided recessed into disc 15, in this embodiment pivoted along with pawl pins 20 and urged by springs 21 into engagement with ratchet teeth 17, so that clockwise wrenching torque may be applied to nut 22 through handle 11. Tongues 19 slide over the ratchet teeth when handle 11 is rotated counter clockwise so that the wrench may be oscillated within a small arc to tighten or loosen nut 22. Preferably, pawl pins 20 are loosely retained within bores 23 in disc 15 so that the pin ends 24 of pawls 19 bear against portions 25 of pawl recesses 26. Wrenching force against tongue pawls 19 is not transmitted to the small pins 20 but against bearing portions 25 of the recesses 26. When wrench disc 15 is disengaged from jaws 12 and 13, pawls 19 bear against the adjacent sides of recess 26 to retain pawls 19 within recess 26. The pawl recesses 26 may be placed in the thicker portions of disc 15 to avoid significent weakening, with pawls 19 spaced at least the space between jaw ends 27 to provide full circle use of disc 15. Neither the jaws nor the discs need be enlarged to provide the pawls.

Retractable jaw 13 has a thinned portion 28 fitting within a slot 29 in handle 11. Jaw 13 is secured to handle 11 by a cam pin 14 through a cam perforation 30 through jaw portion 28. Notches 31 and 32, on handle 11 and jaw 13 respectively, engage each other to prevent rotation of retractable jaw 13 away from ratchet pawls 19. Cam lugs 33 and 34 on pin 14 engage the walls of perforation 30. When pin 14 is rotated counter clockwise, jaw 13 is held in position with the aforesaid notches engaged together. Wrenching forces, components of which are parallel to the sides of notches 31 and 32, tend to pull jaw 13 from handle 11, but act on cam lug 34 to rotate pin 14 in tightening counter clockwise direction. To loosen jaw 13, pin 14 is rotated in the clockwise direction, cam 33 acting against the upper side of cam perforation 30, forcing notches 31 and 32 out of engagement. Continued rotation of pin 14 rotates jaw 13 away from wrenching disc 15, or it may be further retracted directly by handle 11. (FIG. 9)

Figure 6:
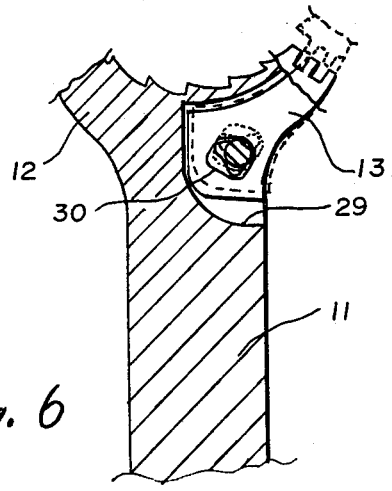

The manner in which notches 31 and 32 are disengaged is indicated in FIGS. 6 & 9, the engaged position of notches, cams and perforation shown in solid and the disengaged position in dashed lines. Rotation of pin 14 through an arc only slightly greater than 90° is required to disengage the jaw retaining notches. However, a single lobed cam (not illustrated) could be employed, in which event pin 14 would require rotation through an angle of 180°. Cam pin 14 comprises coaxial cylindrical portions 35 and 36 held in bores 37 and 39 respectively as by a snap ring 40. (FIGS. 3 & 10) Thumb tab 41 may be provided to facilitate the turning of pin 14.

Handle 11, shown only fragmentally in the drawings, would ordinarily be conventionally straight. However, it may, if desired, be curved, or adapted for engagement of an angled extension or the like to further enhance the utility of wrench 10 in particular locations providing limited access. Locking and retention means other than the illustrated preferred cam and notch arrangement could be employed. The conventional pivoting ratchet pawls 19 could be replaced by equally conventional spring loaded sliding pawl bolts 42 appropriately recessed into disc 15. (FIG. 11) The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. An open ended ratchet wrench comprising:

an elongate handle member;

a jaw member fixed to the handle and having a concave arcuate side with ratchet teeth extending toward its geometric center;

a retractable jaw member having a concave arcuate side with ratchet teeth generally extending toward the ratchet teeth of the fixed jaw member;

a circular wrenching disc having an open ended nut receiving recess and being adapted to be retained by the jaw members between the arcuate faces thereof;

at least two spaced apart pawl members each mounted within one of at least two recesses within the wrenching disc;

spring means urging each pawl member into engagement with the ratchet teeth;

releasable means connecting the retractable jaw to the handle in a disc retaining relationship with the fixed jaw, said releasable means comprising pivot pin means and bore means, said bore means being carried by the handle and, the pivot pin means being disposed rotatably in said bore means;

the pivot pin means has a longitudinal axis and further comprises cam means eccentric to the longitudinal axis; and the movable jaw further comprises bore means accepting the cam portion of the pivot pin means therewithin, so that rotation of the pivot pin means causes the cam means to act against the bore means of the jaw to move the jaw out of the disc retaining relationship.

2. The wrench of claim 1, further comprising:

interlocking means carried by the retractable jaw member and interlocking means carried by the handle, said interlocking means carried by the retractable jaw member and the handle being adapted to prevent pivoting of the retractable jaw member from a disc retaining position, the cam means and the bore means of the jaw being adapted to disengage the interlocking means carried by the retractable jaw member and the handle from each other upon rotation of the pivot pin means.

3. The wrench of claim 1, wherein:

the pawl members each comprise a bolt and means slideably securing said bolt within the associated recess in the wrenching disc.

4. The wrench of claim 2, wherein:

the pawl members each comprise a tongue and means pivotally securing said tongue within the associated recess in the wrenching disc.

5. The wrench of claim 2, wherein:

the pawl members each comprise a bolt and means slideably securing said bolt within the associated recess in the wrenching disc.

6. The wrench of claim 2, wherein:

the wrenching disc has a circumferential channel to receive the jaws at least partially thereinto with the pawls engaging the ratchet teeth of the jaws within said channel.

7. The wrench of claim 4, wherein:

the wrenching disc has a circumferential channel to receive the jaws at least partially thereinto with the pawls engaging the ratchet teeth of the jaws within said channel.

8. The wrench of claim 5, wherein:

the wrenching disc has a circumferential channel to receive the jaws at least partially thereinto with the pawls engaging the ratchet teeth of the jaws within said channel.

* * * * *